US006578233B1

(12) United States Patent
Avila et al.

(10) Patent No.: US 6,578,233 B1
(45) Date of Patent: Jun. 17, 2003

(54) HINGE MECHANISM FOR OUTDOOR LIGHTING ASSEMBLY

(75) Inventors: Henry M. Avila, Palmdale, CA (US); Joseph A. Straus, Woodland Hills, CA (US); Angel M. Orellana, Los Angeles, CA (US)

(73) Assignee: U.S. Pole Company, Inc., Sun Valley, CA (US)

( * ) Notice: Subject to any disclaimer, the term of this patent is extended or adjusted under 35 U.S.C. 154(b) by 0 days.

(21) Appl. No.: 09/668,659

(22) Filed: Sep. 22, 2000

Related U.S. Application Data

(60) Provisional application No. 60/155,694, filed on Sep. 23, 1999.

(51) Int. Cl.[7] ..... E05D 11/10

(52) U.S. Cl. ..... 16/344; 16/357; 16/345; 16/86 C; 362/374; 362/375

(58) Field of Search ..... 16/344, 345, 357, 16/361–364, 86 C, 235, 239, 246, 371, 389, 387; 292/262, 267, 270, 274; 362/374, 375, 223, 260, 225

(56) References Cited

U.S. PATENT DOCUMENTS 2,639,460 A * 5/1953 Schonitzer ..... 16/86 C
2,833,081 A * 5/1958 Pottern ..... 108/9
3,185,835 A * 5/1965 Muller et al. ..... 362/225
3,697,743 A * 10/1972 Eargle ..... 362/260
5,193,248 A * 3/1993 Taylor et al. ..... 16/335
5,474,344 A * 12/1995 Lee ..... 16/86 C
5,812,285 A * 9/1998 Lin et al. ..... 355/25

* cited by examiner

*Primary Examiner*—Chuck Y. Mah
(74) *Attorney, Agent, or Firm*—Christie, Parker & Hale, LLP

(57) ABSTRACT

A hinge mechanism for a lighting assembly has a base with a slot, a shuttle guide extending from edges of the slot, a shuttle coupled with the base and capable of sliding through the slot and shuttle guide between an up position and a down position, and a link rotatably coupled to an end of the shuttle. An angle between the shuttle guide and the base is acute to allow the shuttle to easily slide into the shuttle guide. The base has a catch lip that extends from a back edge of the slot, wherein the catch lip is capable of deflecting the link slightly as the shuttle passes through the slot. Apertures in the shuttle and the shuttle guide align when the shuttle is in the up position. The link has a lip that inserts into the apertures in the shuttle and the shuttle guide to releasably hold the shuttle in the up position. The shuttle has tabs on an upper end of its back side to keep the shuttle from dislodging from the shuttle guide.

18 Claims, 6 Drawing Sheets

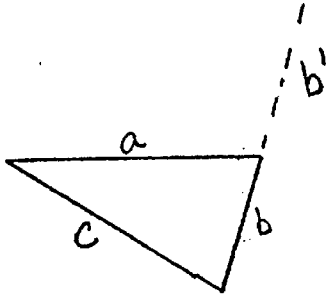
FIG. 6C
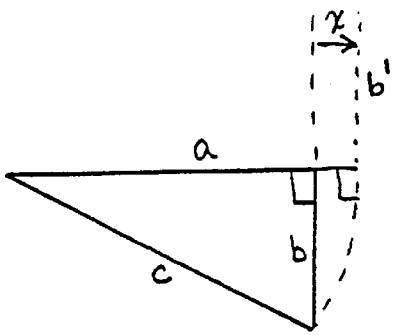
FIG. 6B
FIG. 6A

HINGE MECHANISM FOR OUTDOOR LIGHTING ASSEMBLY

REFERENCE TO RELATED APPLICATIONS

This application claims the benefit of U.S. provisional application No. 60/155,694, filed Sep. 23, 1999.

BACKGROUND OF THE INVENTION

Light bulbs burn out and need to be replaced. For outdoor lighting assemblies, the user usually must climb up a ladder to change the bulb. Two hands are generally needed to close the lighting assembly, one to hold the door and the other to latch it in place. Having both hands occupied, while on top of a ladder, can be difficult. As a result, it is desired to have a hinge mechanism on the lighting assembly where the user need only use one hand to open and close the door. Further, the hinge on the back of the lighting assembly is exposed to the elements and will wear until replacement becomes necessary. As a result, it is desired to have a hinge inside the light assembly, so that the hinge can be protected from the elements and be operable for a longer period.

SUMMARY OF THE INVENTION

In the present invention, a hinge for a lighting assembly couples a door and a main section of the lighting assembly such that the user may easily access the light source using only one hand. The hinge is substantially encompassed within the lighting assembly. The lighting assembly has a closed position wherein the door covers the bottom of the main section. The door has a transparent or translucent material such there is illumination therethrough.

The hinge mechanism has a base with a slot surrounded by an indentation, a shuttle guide extending from edges of the slot, a shuttle coupled to the base capable of sliding through the slot and shuttle guide, and a link having an end that forms a lip and is rotatably coupled to an end of the shuttle. The base is coupled with the main section and encompassed there within, and the link is coupled with the door. An angle between the shuttle guide and the base is acute. The link rotates between a first stop position wherein the link is substantially perpendicular to the shuttle and a second stop position wherein the link is substantially parallel with the shuttle. The hinge further has a flange along one side of the base that extends from an edge of a bottom surface of the base in a direction substantially perpendicular to the base.

The lighting assembly has a semi-closed position wherein the shuttle is in a down position, and a front part of the door is coupled with a latch to the lighting assembly. In the closed position, the shuttle is in an up position, and the front part of the door is coupled with the latch.

The base has a catch lip that extends from a back edge of the slot, wherein the catch lip is capable of deflecting the link slightly as the shuttle passes through the slot. The catch lip bends at approximately a 45 degree angle away from the slot. The link bends from a first shape when contacting the catch lip, and returns to the first shape after passing through the slot such that the lip of the link engages and protrudes through an aperture in the shuttle.

The shuttle guide has an aperture in its back surface. The shuttle aperture and the shuttle guide aperture align when the door is in the closed position, and the shuttle is in the up position. The shuttle is capable of sliding through the shuttle guide and has tabs on an upper end of its back side to keep the shuttle from dislodging from the shuttle guide.

DESCRIPTION OF THE DRAWINGS

FIG. 6A is a schematic view illustrating closing of a door (c) when a shuttle (b) is perpendicular to a bottom (a) of the lighting assembly;

FIG. 6B is a schematic view illustrating closing of the door (c) when the shuttle (b) is at an acute angle relative to the bottom (a) of the lighting assembly; and FIG. 6C is a schematic view illustrating closing of the door (c) when the shuttle (b) is at an obtuse angle relative to the bottom (a) of the lighting assembly according to the present invention.

DETAILED DESCRIPTION OF THE INVENTION

Figure 1:
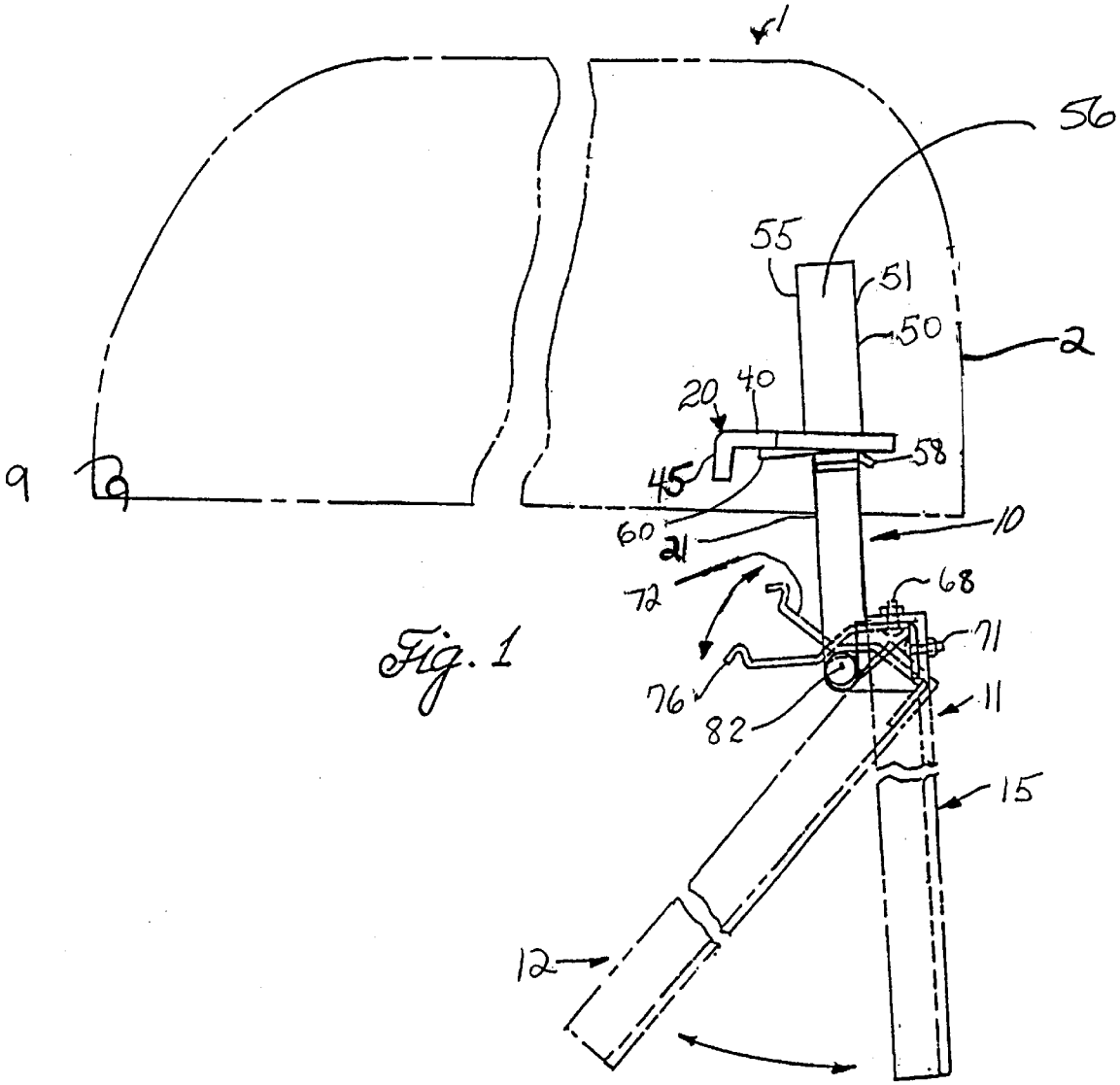
FIG. 1 is a cross-sectional side view of a hinge mechanism attached to a lighting assembly in an open position and a partially open position according to the present invention.
Figure 2:
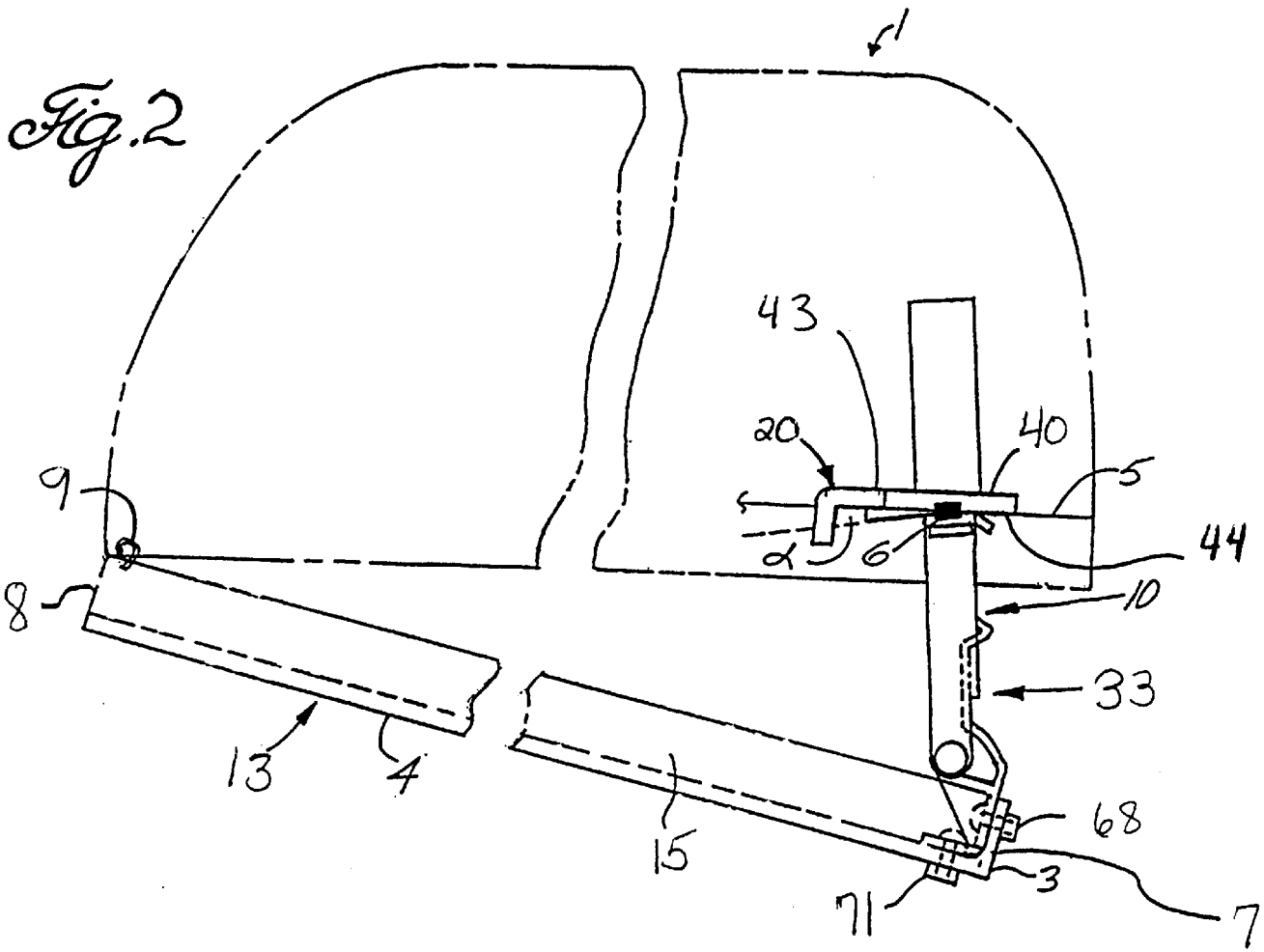
FIG. 2 is a cross-sectional side view of a lighting assembly in a semi-closed position according to the present invention.
Figure 3:
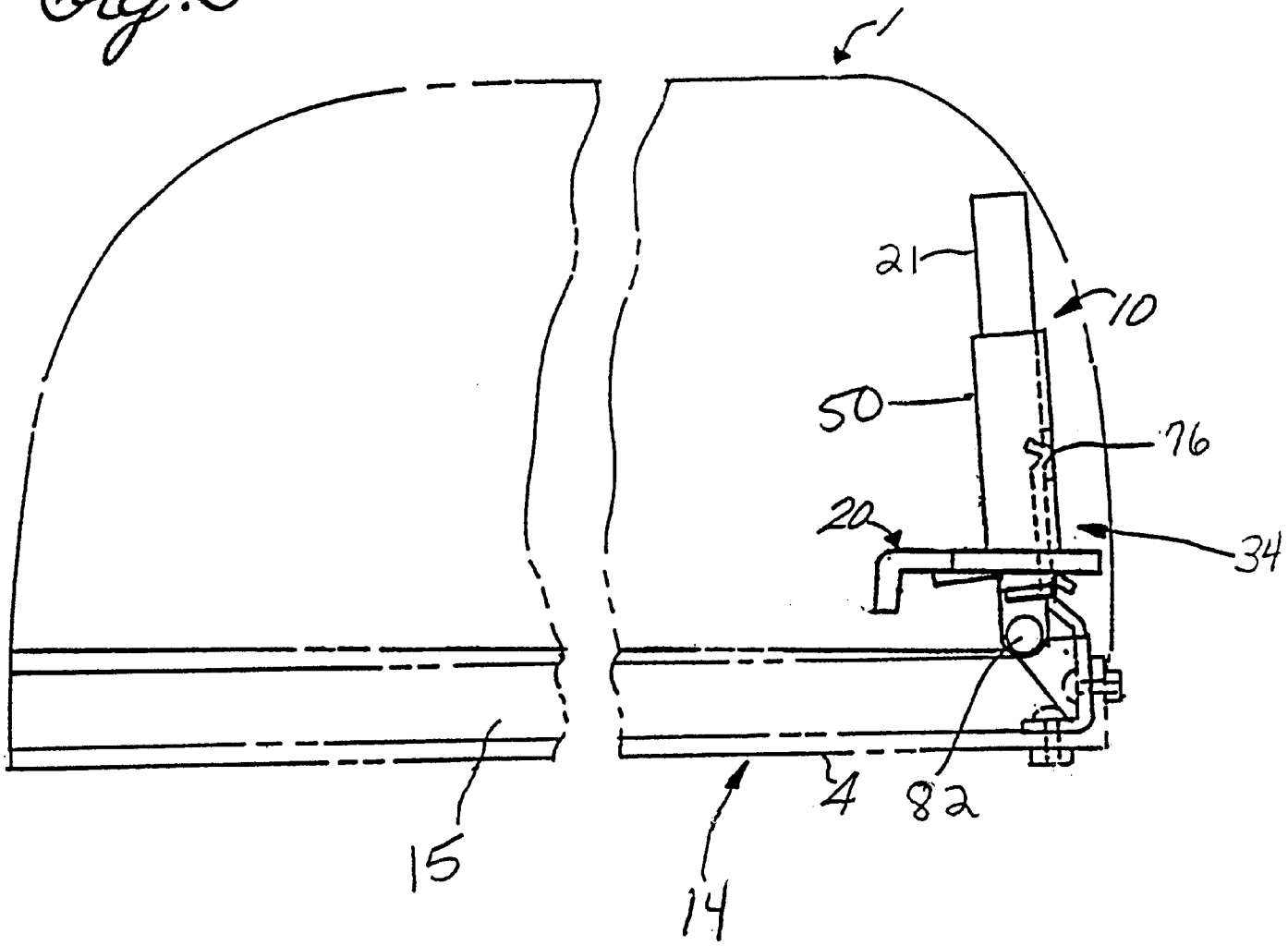
FIG. 3 is a cross-sectional side view of the lighting assembly in a closed position according to the present invention.

FIGS. 1 to 3 illustrate cross-sectional side views of a hinge mechanism 10 attached to a lighting assembly 1 in different positions. FIG. 1 shows the hinge mechanism 10 attached to the lighting assembly 1 in an open position 11 and a partially open position 12. FIG. 2 shows the lighting assembly in a semi-closed position 13. FIG. 3 shows the lighting assembly in a closed position 14. The hinge mechanism 10 couples the lighting assembly 1 to a door 15 and is substantially encompassed by the door and a main section 2 of the lighting assembly. The door 15 rotates with respect to the lighting assembly from the closed position 14 through the semi-closed position 13 to the partially open position 12 to the open position 11 shown in FIG. 1.

Figure 4:
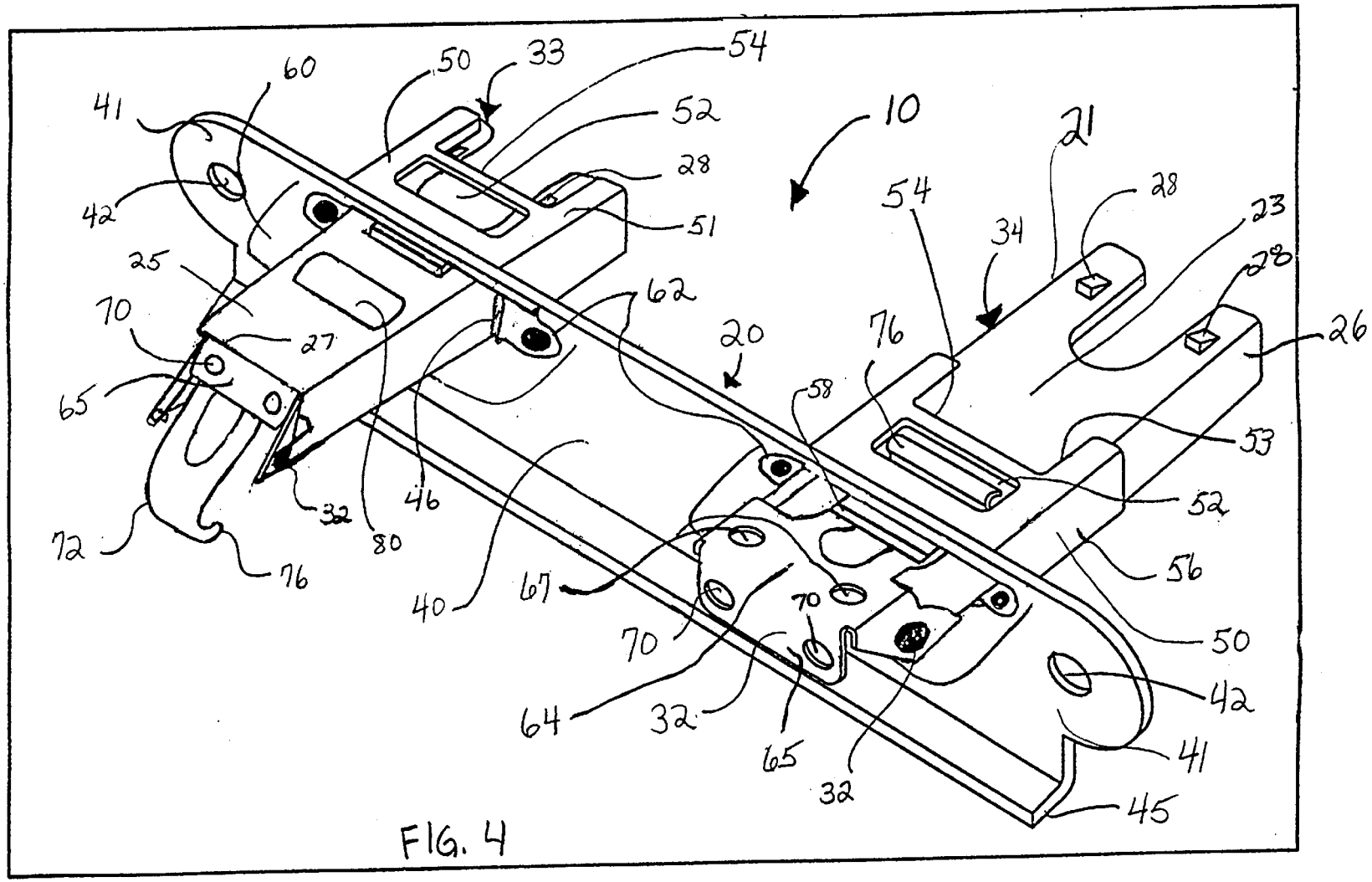
FIG. 4 is a perspective view of a hinge mechanism viewed from below with two shuttles where one is in an up position, and the other is in a down position.

As shown in FIG. 4, the hinge mechanism has an elongated mounting bracket 20, which has two shuttles 21 sliding therethrough, and two links 32 respectively coupled to the two shuttles. Each shuttle 21 has a bottom end 25 with an edge 27, and an upper end 26 opposite the bottom end 25. The shuttles move between a down position 33, and an up position 34, each shown in FIG. 4. Each link 32 is coupled to the bottom end 25 of one of the shuttles 21. The two links 32 couple to the door 15 of the lighting assembly 1, as described in more detail below.

Figure 5:
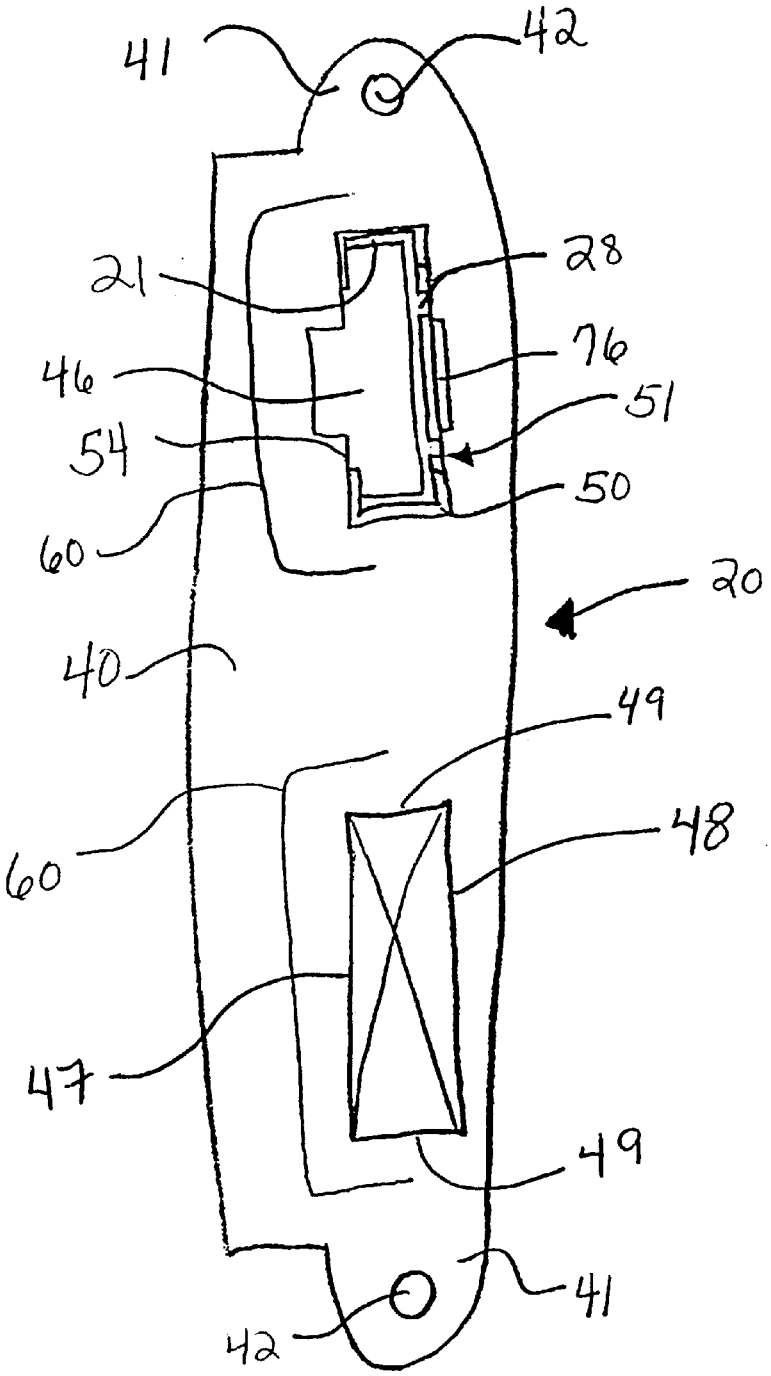
FIG. 5 is a top view of the hinge mechanism of the present invention.

As shown in FIGS. 4 and 5, the elongated mounting bracket 20 has a base 40 with rounded ends 41. The rounded ends 41 each have a mounting hole 42 for attaching the hinge mechanism to the lighting assembly. As shown in FIG. 2, the base 40 has a top surface 43 and a bottom surface 44. The bottom surface 44 is mounted to a surface 5 inside the lighting assembly 1, the surface 5 being substantially horizontal. Connectors 6 couple the surface 5 inside the lighting assembly 1 to the mounting bracket through the mounting holes 42.

As shown in FIG. 4, the mounting bracket 20 has a flange 45 along one side of the base 40 in between the rounded ends 41. The flange 45 is coupled with and extends from an edge of the bottom surface 44 in a direction substantially perpendicular to the base 40. The flange 45 provides stability in the hinge mechanism during operation.

As best shown in FIG. 5, the base 40 further has two slots 46 spaced from each other and in between the two mounting holes 42. The slots 46 are substantially rectangular in shape and have a front edge 47, a back edge 48 opposite the front edge 47, and side edges 49 that couple the front and back edges, as shown in FIG. 5.

As shown in FIGS. 1, 4 and 5, the mounting bracket 20 has a shuttle guide 50 extending from the edges of each of the slots 46, in a direction opposite the flange 45. Each shuttle guide 50 is substantially C-shaped in cross-section thereby permitting the shuttles 21 to slide therethrough. The shuttle guides 50 each have a back surface 51 extending from the back edge 48, a front surface 55 opposite the back surface extending from the front edge 47, and side surfaces 56 that couple the front and back surfaces and extend from the side edges 49. The back surface 51 has an aperture 52 and a U-shaped cut out section 53 from an upper edge of the back surface. The U-shaped cut out section 53 has a lower edge 54. The angle between the front surface 55 of the shuttle guide 50 and the base 40 is acute, as shown in FIG. 1. Accordingly, the shuttle guides 50 as well as the shuttles 21 are at a slight angle with respect to the base 40, as described and explained in more detail below with regard to FIGS. 6A to 6C.

As shown in FIGS. 1 and 4, the base 40 further has a catch lip 58 that extends from the back edge 48 of each of the slots 46, in a direction opposite the extension of the shuttle guides 50 from the slots 46. The catch lips 58 bend at approximately a 45 degree angle away from the slot 46. The catch lip 58 extends partially along the length of the back edge 48 of each of the slots 46 and is centrally positioned. The angled catch lip 58 deflects the link 32 slightly as the shuttle 21 passes through the shuttle guide 50 to the up position 34, as explained in more detail below.

As shown in the cross-sectional view of FIG. 1 and the plan view of FIG. 5, indentations 60 are punched out from the base 40 of the mounting bracket, and protrude from the bottom surface 44. The indentations 60, respectively, substantially surround each slot 46 on three sides: the front edge 47 and the two side edges 49. The indentations 60 have an angle $\alpha$ with respect to the base 40 and are substantially perpendicular to the shuttle guides 50, as shown in FIG. 2.

In order to close the door 15 of the lighting assembly, a front part 8 of the door couples with a latch 9 on a front-bottom of the lighting assembly, as shown in FIG. 2. When the front part 8 couples with the latch 9 initially, the lighting assembly is in a semi-closed position 13 of FIG. 2, where the door 15 is angled relative to the lighting assembly. In the semi-closed position, the shuttle is in the down position 33, a back part 7 of the door is downwardly spaced from the lighting assembly, and the front part 8 of the door is latched to the lighting assembly.

The shuttles 21 and shuttle guides 50 are angled with respect to the base to effectively close the door 15 to the hinge assembly. Referring to FIGS. 6A to 6C, a triangle represents the door, hinge mechanism and light combination. The door is represented by c, the shuttle of the hinge mechanism is represented by b, and a lighting assembly bottom is represented by a.

Because the door fits snugly over the bottom of the lighting assembly as shown in FIG. 3, the lighting assembly bottom a is approximately the same length as the door c. In this instance, if the shuttle were perpendicular to the mounting bracket as in FIG. 6A, the slot 46 through which the shuttle 21 slides would be a distance x wider than side edges of the shuttle. In many instances the wide slot would be undesirable because the shuttle could easily fall to the down position unintentionally.

If the angle between the lighting assembly bottom a and the shuttle b is acute as shown in FIG. 6B, the design is not optimal and the shuttle has an undesirable up position. When the shuttle b moves to the up position and enters the lighting assembly, the shuttle b pushes into the back of the lighting assembly. The hinge location is not as close to the back of the door as possible, and to accommodate the shuttle there is a more spacious inner back surface of the lighting assembly.

The triangle shown in FIG. 6C shows the preferred design, where shuttle b is at a slightly obtuse angle with respect to the lighting assembly bottom a. The angle of the shuttle allows the shuttle to be pushed up into the lighting assembly as the door is rotated closed and maintains a snug fit between the components upon reaching the closed position 14. As the lighting assembly moves from the semi-closed position 13 to the closed position 14, the door rotates about the latch 9, and the shuttle b moves into the lighting assembly. In operation, the front part 8 of the door slides forward an amount past the lighting assembly as the door is closing so that the shuttle can maintain the angle of entry. The door 15 lines up flush with the bottom of the lighting assembly.

The back part 7 of the door can be pushed up to the lighting assembly while the door rotates about the latch 9 and the hinge mechanism rotates to the closed position 14. The angle of the shuttle relative to the lighting assembly allows the shuttle to slide through the shuttle guide as the door rotates, because the location of the shuttle 21 with respect to the slot 46 in the mounting bracket does not change.

The shuttle guide 50 has flaps 62 that extend from the side surfaces 56 through the slots 46. The flaps wrap around the side edges 49 of the slots and couple with the bottom surface 44 of the base 40 to secure the shuttle guide to the mounting bracket. The flaps 62 can be riveted, welded, or attached to the base by similar or known means.

As shown in FIG. 4, each link 32 has an in-line plate 64, and a supporting plate 65 that is substantially perpendicular to the in-line plate 64. As shown in FIG. 2, the in-line plate 64 has two holes 67 that receive connectors 68 which couple the link 32 with a back side 3 of the door 15. Similarly, the supporting plate 65 has two holes 70 that receive connectors 71 which couple the link 32 with a door bottom 4 of the back portion of the door 15.

As shown in FIG. 1, extending from the in-line plate 64 of the link 32 is a hooked latch 72. The hooked latch 72 has a curved surface with a central oval-shaped recess 73 and a lip 76. The lip 76 extends along an end of the hooked latch opposite the in-line plate 64. The lip is capable of latching the hooked latch 72 into the shuttle aperture 80, as described in more detail below. The hooked latch 72 extends out at least twice as long as a length of the in-line plate 64. The curved surface of the hooked latch allows the lip 76 to be received into the shuttle aperture 80 and the shuttle guide aperture 52 such that the lip 76 is flush with the back surface 51 of the shuttle guide 50, as shown in FIG. 3. The hooked latch 72 acts as a spring when bending at an area coupling the hooked latch 72 with the in-line plate 64, as described in more detail below.

As shown in FIG. 4, at the upper end 26 of each shuttle 21 is a U-shaped back side 23 with two punched out tabs 28, wherein one tab is along each side of the U-shape. In an alternative embodiment, the back side 23 is a flat surface and the upper end 26 has the punched out tabs 28 along edges of the back side 23. When the shuttle is in the down position 33, the tabs 28 abut against the lower edge 54 of the shuttle guide 50 to limit the motion of the shuttle 21 and to keep the shuttle 21 from dislodging from the shuttle guide 50. When the shuttle is in the down position 33, the lighting assembly is in either the open position 11, the partially open position 12, or the semi-closed position 13.

When the shuttle travels from the down position 33 to the up position 34, and the front part 8 is coupled with the latch 9, the catch lip 58 abuts either the hooked latch 72 or the in-line plate 64 to stop the shuttle from sliding further up. If the in-line plate 64 abuts the catch lip 58, the door needs to first be rotated (towards the closed position) until the lip 76 enters the aperture 80. The shuttle 21 is then able to move fully into the up position 34 until the hooked latch 72 abuts the catch lip 58.

When the lighting assembly is in the open position 11 and the shuttle is in the down position 33, the shuttle can not be pushed fully into the up position because the shuttle is stopped by the in-line plate of the link contacting the catch lip 58. Preferably, from the open position 11, the door swings through the partially open position 12 and latches to the latch 9 of the lighting assembly into the semi-closed position 13. The lip 76 is now positioned into a first position where the lip protrudes into the shuttle aperture 80, as shown in FIG. 2. The user then is able to press the door up to the closed position.

As the shuttle slides from the down position to the up position, and from the semi-closed position to the closed position, the protruding lip 76 contacts and passes by the catch lip 58. While passing through the slot 46, the lip 76 is pushed flush with the back side 23 of the shuttle into a second position. The hooked latch bends near the area that couples the hooked latch with the in-line plate as the lip 76 is pushed flush with the back side 23. After passing through the slot 46, the lip 76 springs back to the first position to engage and protrude through the shuttle aperture 80 and the shuttle guide aperture 52. The apertures 52, 80 are now aligned in the shuttle up position. The door slightly rotates towards the back side of the shuttle. The shuttle does not slide down from this position as long as the latch 9 holds up the front part 8 of the door, as described in more detail below, due at least in part to the bottom of the lip 76 resting on bottom edges of the apertures 52 and 80. Further, the angle of the hinge keeps tight tolerances, as well as keeps the hooked latch pressed against the upper end 26 of the shuttle. The advantage of this hinge mechanism is that the user need only use one hand to close and latch the door.

Hinge pins 82 pivotally attach the link 32 to the shuttle 21 so that the link 32 can rotate with respect to the shuttle 21. When the shuttle is in the down position 33, the link moves in a rotational direction to a first stop. At this first stop the lighting assembly is then in the open position 11 as shown in FIG. 1, and the door is in a substantially vertical position. The link 32 rotates until coming to the first stop wherein the in-line plate 64 of the link 32 abuts the edge 27 of the bottom end 25 of the shuttle 21. The link then rotates approximately 90 degrees in an opposite rotational direction until the lip 76 is inserted into the shuttle aperture 80 and the curved surface of the hooked latch 72 abuts against the upper end 26 of the shuttle. The door is then in a substantially horizontal position, and the lighting assembly may then be in the semi-closed position, as shown in FIG. 2. While the link is rotating between these two stops, the lighting assembly is in the partially open position 12, as shown in FIG. 1.

When the front part 8 of the door is not coupled with the latch 9, the door may not be able to remain attached to the main section of the lighting assembly without additional support. Further, the link and hooked latch together have less range of motion when the shuttle is in the up position 34, as compared to the range in the shuttle down position 33. When the door is rotated to a substantially horizontal position, the curved surface of the hooked latch abuts against the upper end 26 of the shuttle. The shuttle is then moved into the up position where the lip 76 is in the aperture 80. When the door is then rotated in the opposite direction, the door rotates for approximately 45 degrees before coming to a stop: the hooked latch 72 abuts the inside edge 47 of the slot 46. The door is then somewhere in between the substantially vertical open position and the semi-closed position. To move the door from this configuration, the hooked latch is positioned in between the shuttle and slot edges, and the shuttle 21 may then slide out of the up position to the down position.

In order to service the elements, including the light bulbs, in the lighting assembly, the door to the assembly must be opened. Upon turning the latch 9 at the front of the lighting assembly, with the help of gravity, the link rotates slightly so that the shuttle 21 slides down, to permit the door to swing to the open position 11 shown in FIG. 1. Only one hand is needed to turn the latch, and the door then opens by gravity. Alternatively, if the frictional resistance at the hinge pins is large enough, the lip 76 is pressed into and remains resting upon bottom edges of the apertures 52, 80. The door may remain closed until the door is pulled down to the semi-closed position and then pulled out to the open position. After servicing the lighting assembly, the door is closed again.

Alternatively, the user can close the door by pushing up the back of the door until the shuttle is in the up position and the door is in the closed position, and then turn the latch to secure the door. This alternative embodiment may require two hands to close the door.

When the lighting assembly is in the closed position, the lights in the lighting assembly are capable of illuminating the desired location. The door preferably comprises a transparent or translucent material such that illumination is possible.

It will be understood that the foregoing is merely illustrative of the principles of the invention, and that various modifications such as a shuttle that can hold the lighting assembly in a closed position without a latch on the lighting assembly, can be made by those skilled in the art without departing from the spirit and scope of the invention. It is, therefore, to be understood that within the scope of the appended claims, this invention may be practiced otherwise than as specifically described.

What is claimed is:

1. A hinge mechanism comprising:

a base with a slot, a shuttle guide extending from edges of the slot, wherein the shuttle guide has a back surface with an aperture, a shuttle coupled with the base and capable of sliding through the slot and shuttle guide, wherein the shuttle has a back side with an aperture, an up position and a down position, wherein when the shuttle is in the up position, the aperture of the shuttle guide substantially aligns with the aperture of the shuttle, and a link rotatably coupled to an end of the shuttle, wherein the link has a first position wherein the link is substantially perpendicular to the shuttle and a second position wherein the link is substantially parallel with the shuttle, wherein the link is rotatable between the first position and the second position.

2. The hinge mechanism of claim 1 further comprising a flange along one side of the base, wherein the base has a bottom surface, wherein the flange is coupled with and extends from an edge of the bottom surface of the base in a direction substantially perpendicular to the base.

3. The hinge mechanism of claim 1 wherein the link has an end with a lip that inserts into the aperture in the back side of the shuttle when the link is at the second stop position.

4. The hinge mechanism of claim 1 wherein the link has an end with a lip that inserts into the aperture in the shuttle and the aperture in the shuttle guide when the shuttle is in the up position.

5. A hinge mechanism comprising:

a base with a slot, wherein the base has a bottom surface and a catch lip that extends from the bottom surface at a back edge of the slot;

a shuttle coupled with the base and capable of sliding through the slot; and a link rotatably coupled to an end of the shuttle, wherein the link has a first position wherein the link is substantially perpendicular to the shuttle and a second position wherein the link is substantially parallel with the shuttle, wherein the link is rotatable between the first stop position and the second stop position, wherein the catch lip is capable of deflecting the link slightly as the shuttle passes through the slot.

6. The hinge mechanism of claim 5 wherein the catch lip bends away from the slot at an angle of approximately 45 degrees relative to the bottom surface of the base.

7. The hinge mechanism of claim 5 wherein the link has a first shape and a second shape and bends from the first shape to the second shape when contacting the catch lip, and the link springs back to the first shape after passing through the slot such that the link lip engages and protrudes through the shuttle aperture.

8. A lighting assembly comprising:

a main section enclosing a light source and having a bottom;

a door hingedly coupled with the main section to cover the bottom of the main section; and a hinge mechanism coupling the door and the main section, the hinge mechanism having a base coupled with the main section and having a slot, a shuttle guide extending from edges of the slot and having a back surface with an aperture, a shuttle coupled with the base and capable of sliding through the slot and shuttle guide, wherein the shuttle has a back side with an aperture, an up position and a down position, wherein when the shuttle is in the up position, the aperture of the shuttle guide substantially aligns with the aperture of the shuttle, and a link coupled with the door and rotatably coupled to an end of the shuttle, wherein the link has a first position wherein the link is substantially perpendicular to the shuttle and a second position wherein the link is substantially parallel with the shuttle, wherein the link is rotatable between the first position and the second position.

9. The lighting assembly of claim 8 wherein the shuttle has an up position and a down position and is capable of moving between the up and down positions, wherein the door has a front part, the lighting assembly further comprising a latch that couples with the front part of the door and a semi-closed position wherein the shuttle is in the down position and the front part of the door is coupled with the latch, wherein when the lighting assembly is in the closed position, the shuttle is in the up position, and the front part of the door is coupled with the latch.

10. The lighting assembly of claim 9 wherein the shuttle has a back side with an aperture, wherein the link has a first end that is coupled to the door and a second end that forms a lip, wherein the lip inserts into the shuttle aperture when the link is at the second stop position.

11. The lighting assembly of claim 10 further comprising a shuttle guide extending from edges of the slot and having a back surface with an aperture, wherein the shuttle is capable of sliding through the shuttle guide, wherein the shuttle aperture and the shuttle guide aperture align when the door is in the closed position, and the shuttle is in the up position.

12. The lighting assembly of claim 11 wherein the link lip inserts through the shuttle aperture into the shuttle guide aperture when the shuttle is in the up position and the door is in the closed position.

13. The lighting assembly of claim 8 wherein the door has at least one of a transparent and translucent material such there is illumination therethrough.

14. A hinge mechanism comprising:

a base with a slot;

a shuttle slidably mounted in the slot of the base and having a generally open interior and a back side with an aperture extending therethrough; and a link rotatably coupled to an end of the shuttle and having a lip extending from a end of the link, wherein the link is rotatable between a first stop wherein the link is substantially perpendicular to the shuttle and a second position wherein the link is substantially parallel with the shuttle and the lip of the link extends through the aperture in the back side of the shuttle.

15. The hinge mechanism of claim 14 further comprising a shuttle guide extending from edges of the slot, wherein the shuttle is capable of sliding through the shuttle guide.

16. The hinge mechanism of claim 15 wherein the shuttle has a back side and a tab on an upper end of the back side, wherein the link and the tab keep the shuttle from dislodging from the shuttle guide.

17. The hinge mechanism of claim 14 further comprising an indentation with a main surface punched out from the base, wherein the indentation substantially surrounds the slot, and the main surface is substantially perpendicular to the shuttle.

18. A lighting assembly comprising:

a main section enclosing a light source and having a bottom;

a door hingedly coupled with the main section to cover the bottom of the main section; and a hinge mechanism coupling the door and the main section, the hinge mechanism comprising:

a base coupled to the main section and having a slot;

a shuttle slidably mounted in the slot of the base and having a generally open interior and a back side with an aperture extending therethrough; and a link coupled to the door and rotatably coupled to an end of the shuttle and having a lip extending from a end of the link, wherein the link is rotatable between a first stop wherein the link is substantially perpendicular to the shuttle and a second position wherein the link is substantially parallel with the shuttle and the lip of the link extends through the aperture in the back side of the shuttle.

* * * * *